United States Patent [19]

Wilden et al.

[11] 4,242,941

[45] Jan. 6, 1981

[54] ACTUATOR VALVE

[75] Inventors: James K. Wilden, Yucaipa; Alan D. Tuck, Jr., Upland, both of Calif.

[73] Assignee: Wilden Pump & Engineering Co., Colton, Calif.

[21] Appl. No.: 38,685

[22] Filed: May 14, 1979

[51] Int. Cl.[3] ..... F01L 25/06

[52] U.S. Cl. ..... 91/319; 91/307; 91/329

[58] Field of Search ..... 91/307, 319, 329

[56] References Cited

U.S. PATENT DOCUMENTS

| | | | |
|---|---|---|---|
| 414,156 | 10/1889 | Mahnicke | 91/307 |
| 3,071,118 | 1/1963 | Wilden | 91/282 |
| 3,513,917 | 5/1970 | Stober | 91/319 X |
| 3,916,764 | 11/1975 | Crover | 91/319 X |
| 3,927,601 | 12/1975 | van de Moortele | 91/329 |
| 4,172,698 | 10/1979 | Hinz et al. | 91/329 X |

*Primary Examiner*—Robert L. Bleutge
*Attorney, Agent, or Firm*—Lyon & Lyon

[57] ABSTRACT

An actuator valve for an air driven reciprocating device wherein the valve includes a control rod responsive to movement of the reciprocating device and a valve piston pneumatically actuated by movement of the control rod. The valve piston selectively directs air to reciprocate the driven mechanism. The control rod includes a single axial passageway to selectively vent each end of the cylinder within which the valve piston operates.

4 Claims, 6 Drawing Figures

ACTUATOR VALVE

BACKGROUND OF THE INVENTION

The present invention is directed to actuator valves for air driven reciprocating devices. More specifically, the present invention is directed to an actuator valve for reciprocating devices wherein the valve includes a control rod which reciprocates with the driven mechanism and a pneumatically controlled valve piston.

Actuator valves for reciprocating pneumatically driven devices have been developed which employ a pilot valve or rod responsive to the position of the reciprocating element of the device and a pneumatically controlled valve piston responsive to the pilot rod position. The valve piston in turn controls the incoming flow of pressurized air to provide an alternating flow to the reciprocating element. This alternating flow forces the element to stroke back and forth thereby performing work and driving the pilot rod. Such actuator valves thus convert a relatively steady source of pressurized air into an alternating flow without need for any outside timing or control system. The source air pressure alone drives the valve as well as the working device.

One such actuator valve used primarily on air driven diaphragm pumps is disclosed in U.S. Pat. No. 3,071,118, the disclosure of which is incorporated herein by reference. This pump system has included air driven diaphragms positioned on either side of an actuator valve in an arrangement substantially identical, outwardly of the actuator valve and pilot or control rod, to the pump shown in FIG. 1 herein. In the earlier actuator valves employed with these pumps, the valve piston has been oriented vertically and the pilot rod has included two axial passages for selectively venting the appropriate ends of the chamber within which the valve piston is to operate. Vents for the axial passages have been positioned outwardly of the valve piston vents along the passageway through which the control rod extends. In this way each axial passage on the control rod would vent only one end of the cylinder within which the valve piston operates through movement of the control rod inwardly until the axial passage becomes exposed to a valve piston vent. Thus, each axial passage must cross the O-ring seals separating the air cavities of the reciprocating device from the vent passages through the actuator valve housing.

SUMMARY OF THE INVENTION

The present invention is directed to an improvement on the commercial application of the actuator valve disclosed in U.S. Pat. No. 3,071,118. A new control rod and new vent passages have been designed which allow the central portions of the control rod passageway to be isolated from the air chambers of the reciprocating device. This is accomplished by employing a single axial passage cut into the control rod and using vents for the control rod which are located between the vent passages for the valve piston. This control rod and vent arrangement isolates the central portions of the control rod passageway because the axial passage cut into the control rod does not trasverse the outermost O-ring during normal operation. In this way, a continuous seal is maintained against the reciprocating control rod.

By not having the axial passage move past the outermost O-ring, air from the air chamber of the working device cannot pass to exhaust along the control rod at any time during the operation of the device. This is advantageous in the use of diaphragm pumps because the diaphragms are necessarily made of flexible material and tend to wear out faster than the remaining parts of the device. When these diaphragms fail, they develop cracks through which the material being pumped can pass. As much of the material being pumped in practical applications of these pumps is abrasive or corrosive, adverse effects are experienced by the actuator valve when this material is able to reach the internal portions of the actuator valve. Such a condition has been avoided by the total sealing of the control rod passageway in the present invention.

Another advantage of the present invention is the avoidance of the compressed air itself escaping across the seals in the control rod passageway, a condition known as blow-by. The axial passage of the control rod does not cross the outermost seal in the present device and the compressed air in the adjacent air chamber is not able to reach the exhaust passage. Thus, there is no direct blow-by in the device and the air actually needed to fill the air chambers to drive the reciprocating device and to shift the valve piston is substantially all that is used.

The lack of blow-by becomes even more important when the reciprocating device carries a load approaching the stall point. With such a pneumatic device, the available power is limited to the pressure of the compressed air. If blow-by is experienced, the available power is reduced by these losses and stall can occur.

The use of a single axial passage on the control rod and the new vent passages have created a side benefit as well. The O-ring seals, which must be periodically replaced, are near the ends of the control rod passageway and can be easily reached in the present embodiment. Also, this new mechanism reduces machining costs and machine complexity.

Accordingly, it is an object of the present invention to provide an improved actuator valve for an air driven reciprocating device. Other and further objects and advantages will appear hereinafter.

DETAILED DESCRIPTION OF THE PREFERRED EMBODIMENT

Figure 1:
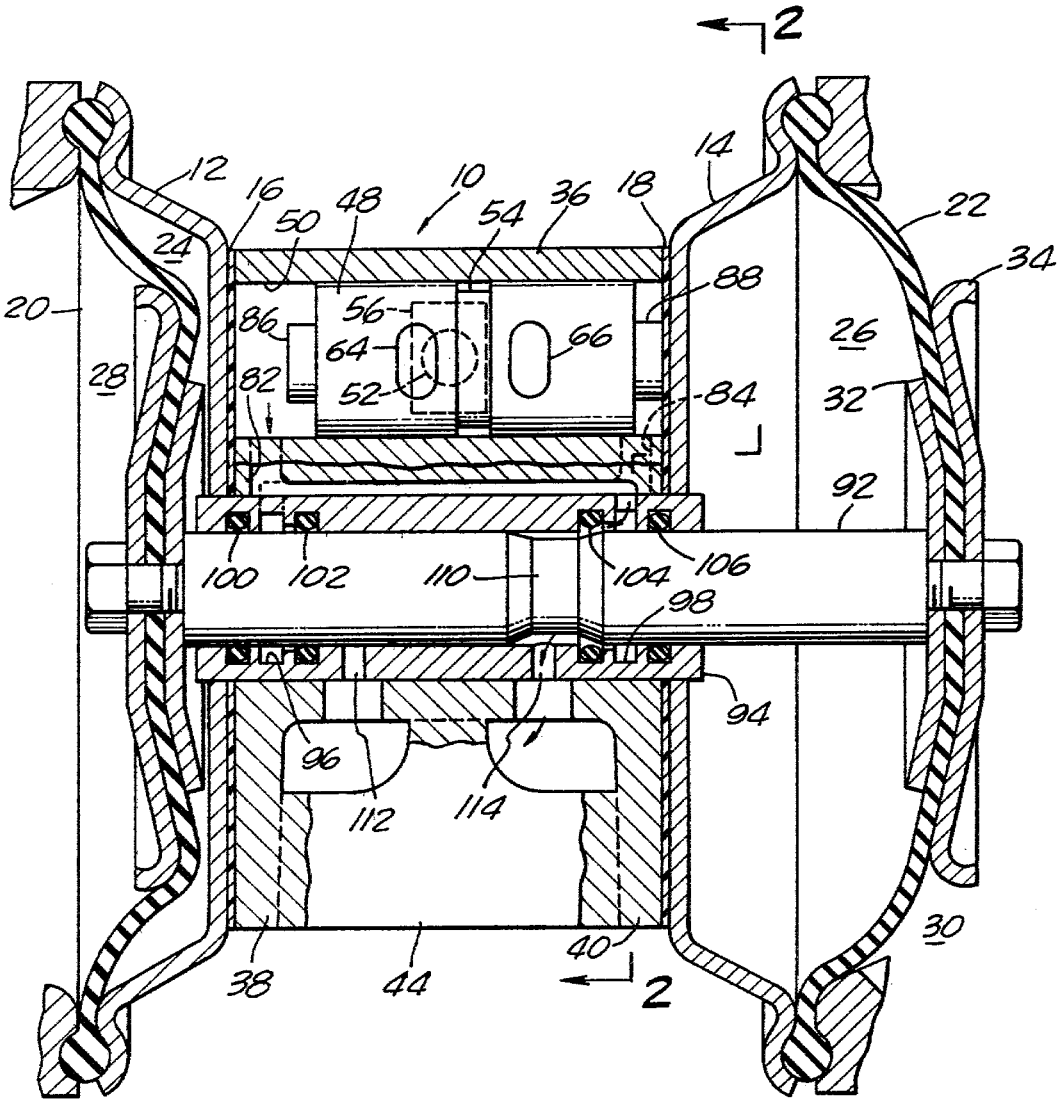
FIG. 1 is a cross-sectional elevation of the actuator valve of the present invention shown in assembly with the diaphragms of an air driven diaphragm pump.

Turning in detail to the drawings, FIG. 1 illustrates the actuator valve of the present invention in conjunction with fragmented portions of an air driven diaphragm pump. The actuator valve, generally designated 10, includes a housing, a valve piston positioned in the housing and a control rod extending through the housing.

The actuator valve 10 is positioned between opposed pump cavities with which it cooperates. One overall configuration of an air driven diaphragm pump which may be associated with the actuator valve of the present invention is illustrated in co-pending patent application Ser. No. 29,619, filed Apr. 13, 1979, in the name of James K. Wilden and entitled AIR DRIVEN DIAPHRAGM PUMP. Drive chamber housings 12 and 14 abut the sides of the actuator valve 10 with appropriate gaskets 16 and 18 therebetween. Circular diaphragms 20 and 22 are associated with the drive chamber housings 12 and 14 to form air chambers 24 and 26. Outwardly of the diaphragms 20 and 22 are pump chamber housings 28 and 30. Piston assemblies are located about the center of each of the diaphragms 20 and 22 and each include an inner plate 32 and an outer plate 34 between which the diaphragms 20 and 22 are sandwiched. The inner plate 32 and outer plate 34 of each of the piston assemblies is associated with the control rod of the actuator valve 10 as can best be seen in FIG. 1.

In the context of the air driven diaphragm pump illustrated in FIG. 1, the actuator valve 10 provides a source of alternating pressurized air and exhaust to each of the air chambers 24 and 26. The diaphragms move as a unit because of the rigid coupling provided by the control rod and piston assemblies. The actuator valve 10 supplies pressurized air to one air chamber while exhausting the other air chamber to drive one diaphragm outwardly toward an adjacent pump cavity and to pull the other diaphragm inwardly away from another adjacent pump cavity. In this way, there is an intake stroke in the right pump cavity and a pump stroke on the left pump cavity as the diaphragms move left. At the end of the stroke, the actuator valve reverses the flow and the pump functions are reversed as the diaphragms are forced to move to the right.

Figure 2:
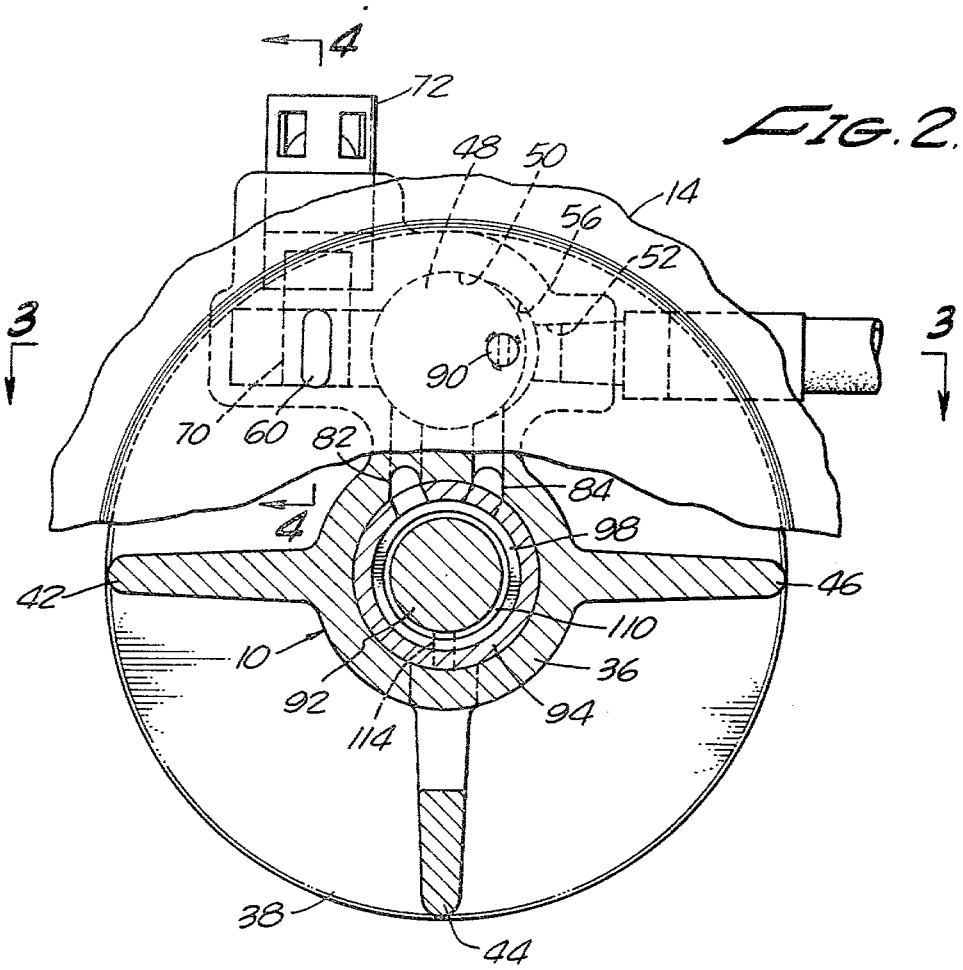
FIG. 2 is a cross-sectional view taken along line 2—2 of FIG. 1.

Looking then specifically to the actuator valve 10, a unitary casting is employed in the preferred embodiment as a housing 36. The housing 36 includes two parallel mounting plates 38 and 40 having flat outer surfaces for mating with the drive chamber housings 12 and 14. The cross-section of the actuator 10 inwardly of the mounting plates 38 and 40 is best seen in FIG. 2. Strengthening webs 42, 44 and 46 extend between the mounting plates 38 and 40. In the upper portion of the casting are located the air inlet, the valve piston and the means for directing air into and out of the reciprocating device. Centrally located in the housing 36 is the control rod and bushing.

The valve piston 48 is positioned in a cylinder 50 formed within the housing 36. The valve piston 48 and cylinder 50 cooperate to provide two major functions. The first is to provide means for selectively directing incoming air to either air chamber 24 and 26 and exhausting the opposite chamber in an alternating manner. The valve piston 48 and cylinder 50 also cooperate to provide a means for directing incoming air to the ends of the valve piston 48 such that the piston is capable of shifting in response to the position of the reciprocating device. To accomplish these functions, the air inlet 52 is directed to the cylinder at a central position spaced from the ends of the cylinder as can best be seen in FIGS. 2 and 3.

Figure 3:
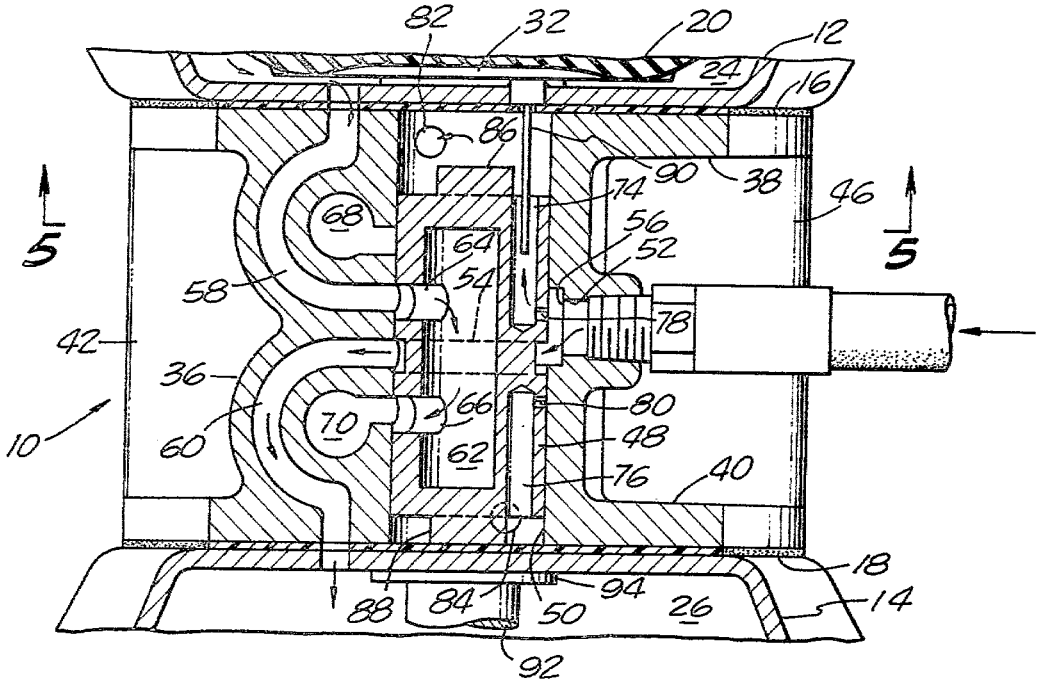
FIG. 3 is a cross-sectional view taken along line 3—3 of FIG. 2.
Figure 4:
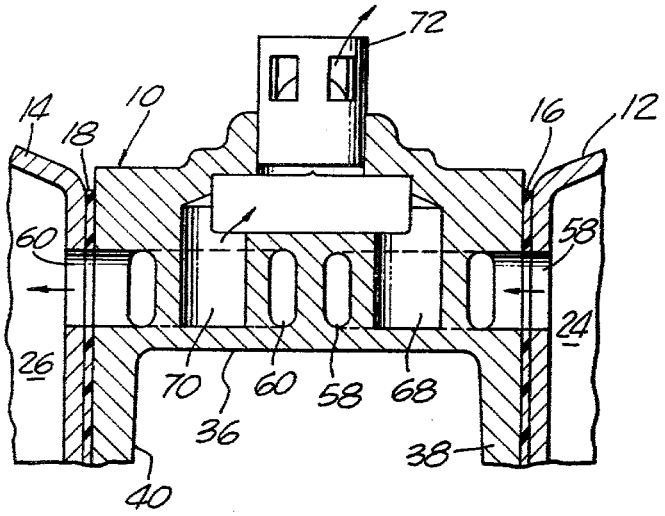
FIG. 4 is a cross-sectional view taken along lines 4—4 of FIG. 2.
Figure 5:
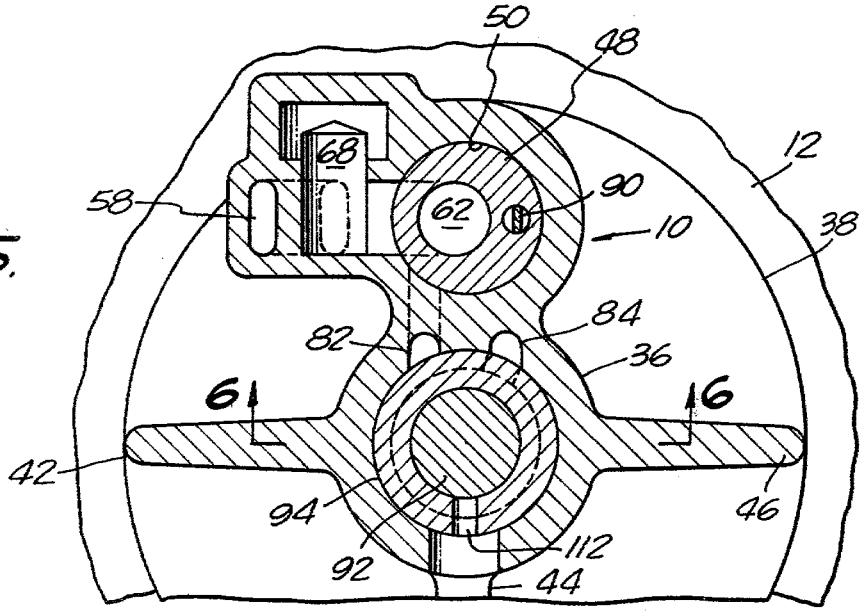
FIG. 5 is a cross-sectional view taken along lines 5—5 of FIG. 3.

In providing a means for charging and exhausting the air chambers of the reciprocating device, the valve piston 48 includes an annular groove or channel 54 which cooperates with an arcuate passage 56 cut in the side of the cylinder 50 to direct air to one or the other of two air chamber ducts 58 and 60 as best seen in FIG. 3. With the channel 54 aligned with the air chamber duct 58, incoming air will pass through the air inlet 52, the arcuate passage 56, the channel 54 and into the air chamber duct 58. Each of the air chamber ducts 58 and 60 is aligned with a hole through the wall of the drive chamber housings 12 and 14. While air is entering one of the ducts 58 and 60, the other duct will operate as an exhaust passage. A cavity 62 exists in the center of the valve piston 48. This cavity 62 enables the air flowing through the exhausting duct to flow through the cavity 62 and through ports 64 and 66 to one of two exhaust ducts 68 and 70. The exhaust ducts 68 and 70 extend to a ball check valve 72 as can best be seen in FIG. 4. When the valve piston 48 is shifted from one end to the other of the cylinder 50, the flow through the air chamber ducts 58 and 60, the cavity 62 and the ports 64 and 66 is reversed. The shift in the valve piston 48 also causes one of the exhaust ducts 68 and 70 to become blocked off while the other is opened for exhausting the alternate one of the air chambers 24 and 26.

The second main function performed by the valve piston 48 and cylinder 50 is the control of the location of the valve piston 48. To this end, the valve piston 48 has a diameter which is slightly smaller than the diameter of the cylinder 50. Thus, air is able to flow in the clearance to both ends of the valve piston 48 regardless of its position in the cylinder 50. This clearance is not illustrated in the figures for simplicity. There are also two axial paths allowing a greater amount of air to selectively flow to one end or the other of the valve piston 48. These axial paths each include a bore 74 and 76 and a hole 78 and 80 drilled into the respective bore. The holes 78 and 80 are spaced such that the distance from inside edge to inside edge is the same as the width of the arcuate passage 56. Thus, only one of the holes 78 and 80 may be exposed directly to the incoming air in the arcuate passage 56 at one time. This selective direction of air through the holes 78 and 80 provides an effective anti-stall feature better described in the earlier U.S. Pat. No. 3,071,118.

To initiate the shifting of the valve piston 48, one or the other of two valve piston vent passages 82 and 84 is opened to atmosphere. These vent passages are located at the ends of the cylinder 50 as can be seen in FIG. 3. During normal operation, the vent passage at the end furthest from the valve piston 48 is vented. The valve piston 48 then moves toward that vented end of the cylinder. During the stroke of the air driven reciprocating device associated with the actuator valve 10, neither end of the cylinder 50 is vented. It is only at each end of the working stroke that venting takes place.

During the working stroke of the air driven reciprocating device, air flows through the clearance between the valve piston 48 and the cylinder 50 and through one of the paths in the valve piston 48. Once pressure has built up at both ends, there is substantially no flow axially in the cylinder 50. Two bosses 86 and 88 form spacers on either end of the valve piston 48 such that an annular air space is created at the ends of the valve piston 48. This air space has been referred to as a shift chamber and acts as a potential energy storage mechanism to effect the shifting of the valve piston 48.

The cylinder and valve piston tolerance and air passage dimensions are such that the ends of the cylinder 50 may be vented much faster than they are replenished with incoming pressurized air. Thus, when venting occurs at one end of the valve piston chamber 50, a pressure imbalance is experienced by the valve piston 48. The shift chamber at the unvented end of the valve piston 48 has a reservoir of compressed air such that the venting of the other end releases the air spring to drive the valve piston 48 to the vented end of the cylinder. Once the valve piston 48 reaches just past half way in its shift through the cylinder 50, the shifting is aided by the axial path of the valve piston 48 extending to the unvented end of the cylinder 50. This mechanism insures a complete shift.

The incoming pressurized air also acts to force the valve piston 48 against the opposite side of the cylinder. This is accomplished even during low flow conditions because the ports 64 and 66 are vented. With these areas of lower pressure, a pressure imbalance is created such that the inlet air pressure will hold the piston against the opposite wall. This biasing of the piston is beneficial because the axial paths created by the valve piston clearance is more uniform and the valve piston can thus seal the air chamber ducts 58 and 60 and exhaust ducts 68 and 70 where appropriate.

The valve piston is contained within the cylinder 50 by means of the drive chamber housings 12 and 14 which define the ends of the valve piston chamber 50. Furthermore, a pin 90 extending into the bore 76 maintains the angular orientation of the valve piston 48.

To achieve the shifting of the valve piston 48 at the appropriate time, a control rod 92 is used. The control rod is fixed to reciprocate with the air driven reciprocating device by either a direct attachment or some conventional form of linkage. The control rod is positioned in a passageway through the housing 36. The control rod 92 further extends into the air chambers 24 and 26 to retain the diaphragm pistons at a fixed spaced distance from one another and in alignment. A bushing 94 fixed to the housing 36 and forming part of the housing provides a guide for the control rod 92.

Figure 6:
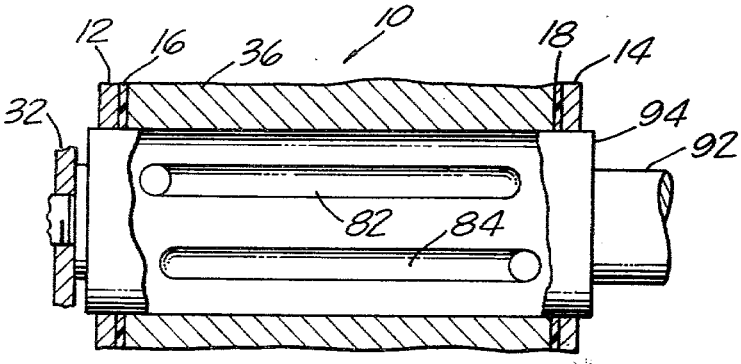
FIG. 6 is a cross-sectional view taken along line 6—6 of FIG. 5 with a portion of the control rod bushing broken out for clarity.

The valve piston vent passages 82 and 84 extend from the ends of the cylinder 50 to circular grooves 96 and 98. The valve piston vent passages 82 and 84 cross over as can best be seen in FIG. 6. Either the valve piston vent passages 82 and 84 or the air chamber ducts 58 and 60 should cross over to opposite ends of the actuator valve 10 so that air flow through the cavity 62 in the valve piston 48 will be toward the end which is abutting the end wall of the cylinder 50. On either side of each of the circular grooves 96 and 98 are circular seats which each contain an O-ring seal 100 through 106 to seal these circular grooves 96 and 98.

The control rod 92 includes an axial passage 110. The axial passage 110 includes truncated conical sections with a central cylindrical section having a reduced diameter from the main body of the control rod 92. This axial passage 110 is positioned between the circular grooves 96 and 98 such that when either of the inner O-rings 102 and 104 are encountered, air communication between the valve piston vent passages 82 and 84 and the axial passage 110 is achieved.

Between the inner O-rings 102 and 104, two control rod vent passages 112 and 114 extend to atmosphere. The control rod vent passages may be in any configuration between the inner seals 102 and 104. For example, one continuous passageway may be employed as flow only occurs when the axial passageway moves across one of the seals at 102 or 104. The outer seals at 100 and 106 are never disturbed by the axial passage 110. Thus, a constant seal is maintained to prevent any matter from entering into the bushing 94 from the air chambers 24 and 26.

Through the use of the single axial passage 110, there is no direct blow-by where pressurized air is lost through open seals. Thus, the air actually needed to fill the air chambers 24 and 26 to move the diaphragms 20 and 22 and the air needed to shift the valve piston 48 is substantially all that is used by the present device.

In overview, the operation of the actuator valve is in the nature of a feedback control system. That is, the location of the valve piston 48 determines the movement of the air driven reciprocating device. The movement of the air driven reciprocating device in turn controls the location of the control rod 92. The control rod location determines the position of the valve piston. The control of the stroke of the air driven reciprocating device is the width of the axial passage 110 and the distance between the seals at the O-rings 102 and 104. Roughly, the distance between the seals 102 and 104 minus the length of the axial passage 110 equals the stroke length of the reciprocating device.

Thus, an improved actuator valve for an air driven reciprocating device is disclosed. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. An actuator valve for an air driven reciprocating device, comprising a valve piston, a control rod fixed to reciprocate with the air driven reciprocating device, and a housing having a cylinder closed at each end and enclosing said valve piston, a passageway through which said control rod extends, an air inlet to said cylinder spaced from the ends of said cylinder, valve piston vent passages extending from the ends of said cylinder to said passageway, and control rod vent passages extending from said passageway to atmosphere, said valve piston cooperating with said housing to include means for directing incoming air to the ends of said valve piston and means for selectively directing incoming air to and exhausting outgoing air from the air driven reciprocating device, wherein the improvement comprises an axial passage in said control rod positioned between said valve piston vent passages to vent selectively each of said valve piston vent passages to said control rod vent passages.

2. The actuator valve of claim 1 wherein the improvement further comprises said control rod vent passages being inwardly of said valve piston vent passages.

3. The actuator valve of claims 1 and 2 wherein the improvement further comprises seals outwardly of said control rod vent passages in said passageway.

4. An actuator valve for an air driven reciprocating device, comprising in combination a valve piston, a control rod fixed to reciprocate with the air driven reciprocating device, a housing having a cylinder closed at each end and enclosing said valve piston, a passageway through which said control rod extends, an air inlet to said cylinder spaced from the ends of said cylinder, valve piston vent passages extending from the ends of said cylinder to said passageway, and control rod vent passages extending from said passageway to atmosphere, said valve piston cooperating with said housing to include means for directing incoming air to ends of said valve piston and means for selectively directing incoming air to and exhausting outgoing air from the air driven reciprocating device, an axial passage in said control rod positioned between said valve piston vent passages to vent selectively each of said valve piston vent passages to said control rod vent passages and seals outwardly of said control rod vent passages in said passageway.

* * * * *